US007105990B2

(12) United States Patent
Shibata et al.

(10) Patent No.: US 7,105,990 B2
(45) Date of Patent: Sep. 12, 2006

(54) SPARK PLUG FOR INTERNAL COMBUSTION ENGINE

(75) Inventors: Masamichi Shibata, Toyota (JP); Tsunenobu Hori, Kariya (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 10/408,089

(22) Filed: Apr. 8, 2003

(65) Prior Publication Data

US 2003/0193282 A1 Oct. 16, 2003

(30) Foreign Application Priority Data

Apr. 10, 2002 (JP) ..... 2002-108073
Feb. 4, 2003 (JP) ..... 2003-027155

(51) Int. Cl.
*H01T 13/20* (2006.01)

(52) U.S. Cl. ..... 313/141; 313/142; 313/144; 123/169 EL

(58) Field of Classification Search ..... 313/141, 313/142, 144; 123/169 EL
See application file for complete search history.

(56) References Cited

U.S. PATENT DOCUMENTS 4,700,103 A * 10/1987 Yamaguchi et al. ..... 313/141
4,845,400 A 7/1989 Takamura et al. ..... 313/142
5,159,232 A 10/1992 Sato et al. ..... 313/141
5,929,556 A * 7/1999 Matsubara et al. ..... 313/141
6,094,000 A * 7/2000 Osamura et al. ..... 313/141
6,316,868 B1 * 11/2001 Ishino et al. ..... 313/141
6,470,845 B1 * 10/2002 Kanao ..... 123/169 EL
6,720,716 B1 * 4/2004 Shibata et al. ..... 313/141
6,750,598 B1 * 6/2004 Hori ..... 313/141

FOREIGN PATENT DOCUMENTS

| | | |
|---|---|---|
| JP | 64-27176 | 1/1989 |
| JP | 9-7733 | 1/1997 |
| JP | 2727558 | 12/1997 |
| JP | 2805781 | 7/1998 |
| JP | 2001-307858 | 11/2001 |

OTHER PUBLICATIONS

Japanese Office Action dated Aug. 3, 2004 with attachment.
Japanese Official Action dated Apr. 25, 2006 issued in foreign counterpart Japanese Application 2003-027155 and translation.

* cited by examiner

*Primary Examiner*—K. Guharay
*Assistant Examiner*—Sikha Roy
(74) *Attorney, Agent, or Firm*—Nixon & Vanderhye PC

(57) ABSTRACT

Carbon fouling adhered on an insulator tip of a spark plug of the present invention is burnt down by a leak current during an inductive discharge period, due to a promoted ionization before beginning a capacitive discharge, in such an arrangement of a central electrode that a border portion of a body and narrowed portion is positioned in an insulator. The carbon burning-down effect is further improved by a narrow projection provided with an earth electrode, due to increased inductive energy and extended inductive discharge time period. This is because an electric field in a discharge gap is raised, thereby decreasing a discharge voltage and suppressing an energy emitted from a coil during the capacitive discharge.

18 Claims, 12 Drawing Sheets

| | | PROJECTION DIAMETER D (mm) | | | | |
|---|---|---|---|---|---|---|
| | | 0.3 | 0.7 | 1.1 | 1.2 | 1.5 |
| PROJECTION LENGTH L (mm) | 0 | × | × | × | × | × |
| | 0.2 | × | × | × | × | × |
| | 0.3 | ○ | ○ | ○ | × | × |
| | 0.5 | ○ | ○ | ○ | × | × |
| | 1.0 | ○ | ○ | ○ | ○ | × |
| | 1.2 | ○ | ○ | ○ | ○ | × |
| | 1.5 | ○ | ○ | ○ | ○ | × |

SPARK PLUG FOR INTERNAL COMBUSTION ENGINE

BACKGROUND OF THE INVENTION

1. Field of the Invention

The present invention relates to a spark plug for an internal combustion engine.

2. Description of the Related Art

There is disclosed in Japanese Patents No. 2727558 and 2805781 a spark plug for an internal combustion engine wherein carbon fouling (contamination) on an insulator tip is burned down by sparks generated during a spark discharge in a discharge gap.

Concretely, an atmosphere around electrodes is ionized by a leak current flowing through the carbon fouling from a time when a high voltage is applied to the electrodes to a time when a capacitive discharge is caused at tips of the electrodes. Then, when an inductive discharge is caused following the capacitive discharge, the carbon fouling on the insulator around the central electrode is burned down, thereby recovering an insulating resistance.

The central electrode of the spark plug is provided with a narrowed portion (narrower than a body) extending to the earth electrode. The ionization by the above-mentioned leak current is promoted by disposing a border portion between the body and the narrowed portion in the insulator.

Although the carbon fouling is burned down at a certain degree according to the above-cited Japanese Patents, it is being desired to further completely remove the carbon fouling, due to demands for further improvements of starting capability under a cold weather and of a drivability.

SUMMARY OF THE INVENTION

An object of the present invention is to further more completely burn down the carbon fouling in the spark plug.

The present invention includes fifteen Features stated below.

In Feature 1, the spark plug for an internal combustion engine of the present invention comprises: a columnar central electrode; an insulator for holding the central electrode; a housing for holding the insulator; an earth electrode wherein one end thereof is connected with the housing and the other end thereof is opposite to the central electrode. The feature 1 is characterized in that: the earth electrode has a leg connected with the housing and a projection smaller than the leg which projects from the leg toward the central electrode; the central electrode has a body held in the insulator and a narrowed portion smaller than the body which projects from the body toward the projection; and a first border portion (33) between the body and narrowed portion is positioned in the insulator.

Here, the reference numeral 33 corresponds to a border portion 33 as shown in FIGS. 1, 8–14.

According to Feature 1, the carbon fouling adhered on the electrodes of a spark plug of the present invention is burnt down by a leak current during an inductive discharge period, due to a promoted ionization before beginning a capacitive discharge, in such an arrangement of a central electrode that a border portion of a body and narrowed portion is positioned in an insulator. The carbon burning-down effect is further improved by a narrow projection provided with an earth electrode, due to increased inductive energy and extended inductive discharge time period. This is because an electric field in a discharge gap is raised, thereby decreasing a discharge voltage and suppressing an energy emitted from a coil during the capacitive discharge.

In Feature 2, a second border portion (33') between the body and narrowed portion is positioned in the insulator.

Here, the reference numeral 33' corresponds to a border portion 33' as shown in FIGS. 10, 12 and 15.

According to Feature 2, due to an increased number of edge portions which become the starting points of the leak current, the ionization by the leak current before the capacitive discharge is not only further ensured, but also the carbon burning-down effect is further improved, due to the increased inductive discharge energy and extended inductive discharge time period.

In Feature 3, a surface of the earth electrode opposite to the central electrode is tilted from a surface (reference surface) perpendicular to an axis of the central electrode.

According to Feature 3, the effect similar to Embodiment 1 is obtained. Further, the end surface of the earth electrode is made tilted to the reference surface. Therefore, heat conductivity is improved by a shortened length of the leg.

In Feature 4, a cross section of the projection is between 0.07 and 1.13 $mm^2$, both inclusive.

If the cross section of the projection is too small, it is not suitable for practical use, because the projection is not heat resistant. Therefore, the projection cross section is made greater than or equal to 0.07 $mm^2$. Further, the projection cross section is made smaller than or equal to 1.13 $mm^2$ in order to increase the inductive discharge energy and extending the inductive discharge time period, thereby ensuring the carbon burning-down effect.

In Feature 5, a length of the projection from the leg is between 0.3 and 1.5 mm, both inclusive.

If the length of the projection is too long, it is not suitable for practical use, because the projection is not heat resistant. Therefore, the projection length is made shorter than or equal to 1.5 mm. Further, the projection length is made longer than or equal to 0.3 mm in order to increase the inductive discharge energy and extending the inductive discharge time period, thereby ensuring the carbon burning-down effect.

In Feature 6, the projection may be made of noble metal material. Further, in Feature 7, the noble metal material may be a Pt alloy or Ir alloy.

In Feature 8 and 9, the ionization by the leak current before starting the capapcitive discharge is surely cased.

According to Features 8 and 9, the ionization by the leak current before starting the capacitive discharge is surely caused.

In Feature 10, the narrowed portion of the central electrode is narrowed a plurality of times from the body toward the projection.

According to Feature 10, due to an increased number of edge portions which become the starting points of the leak current, the ionization by the leak current before the capacitive discharge is not only further ensured, but also the carbon burning-down effect is further improved due to the increased inductive discharge energy and extended inductive discharge time period.

In Feature 11, the narrowed portion includes a tapered member of which cross section may be continuously decreased from the body toward the projection.

In Feature 12, a tip of the narrowed portion is positioned between −1 mm and +2 mm, both inclusive, from an end surface of the insulator.

According to Feature 12, the carbon burning-down capability is improved by the narrow projection provided with the earth electrode. Therefore, even if narrowed portion is positioned between −1 mm and +2 mm, both inclusive, from an end surface of the insulator, the carbon burning-down capability is still maintained.

In Feature 13, the tip of the narrowed portion is positioned in the insulator.

According to feature 13, because the tip surface of the narrowed portion is positioned in the insulator, the carbon fouling adhered on the insulator near the tip of the narrowed portion can be burnt down by the sparks generated between the tip of the narrowed portion of the central electrode and the narrow projection of the earth electrode, thereby further improving the burning-down effect.

In Feature 14, the narrowed portion may be made of noble metal material. Further, in Feature 15, the noble metal material may be a Pt alloy or Ir alloy.

PREFERRED EMBODIMENTS OF THE INVENTION

Figure 1:
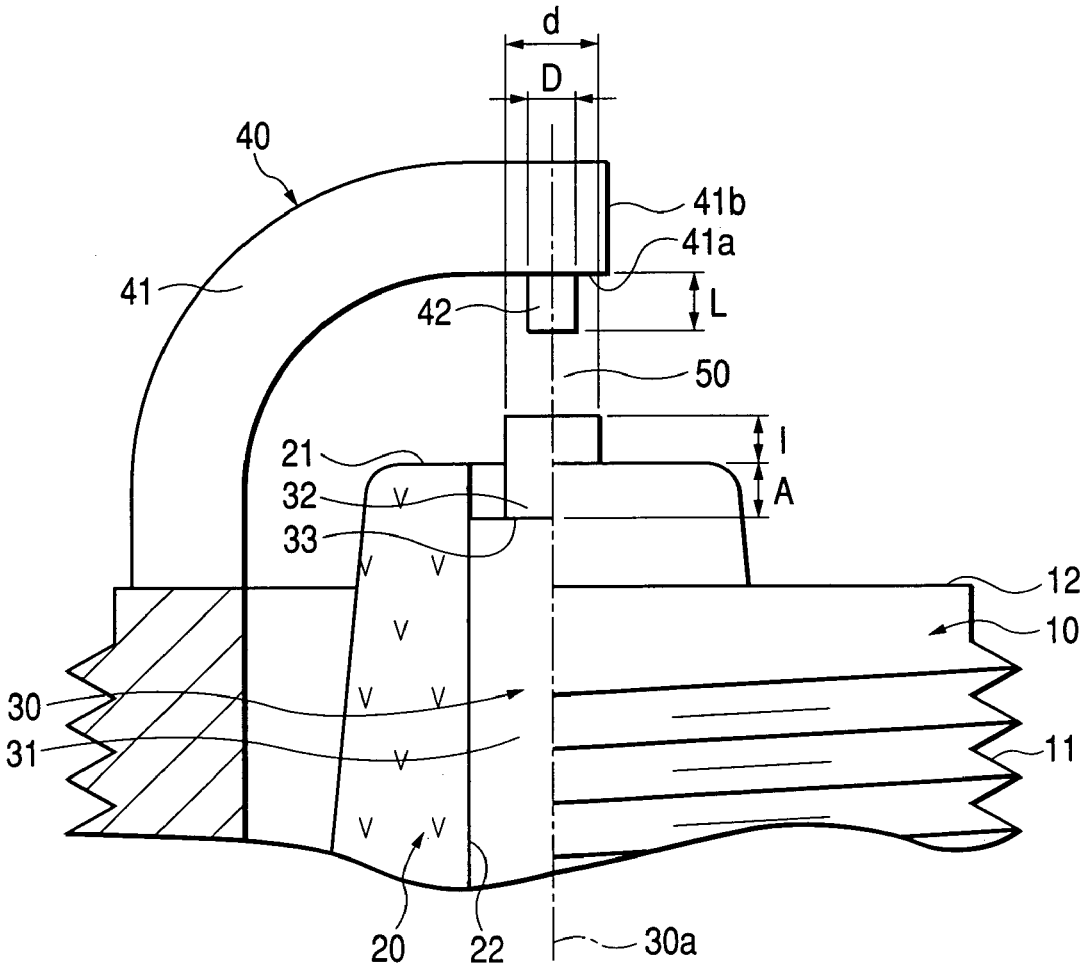
FIG. 1 is a fragmentary cross sectional view of a main portion of the spark plug of Embodiment 1 of the present invention.

Preferred embodiments in accordance with the present invention are disclosed in detail below, referring to the drawings.

Embodiment 1

FIG. 1 is a fragmentary cross sectional view of a main portion of the spark plug of Embodiment 1, wherein a columnar housing 10 (made of a conductive steel material such as a low carbon steel) is provided with a male screw 11 in order to fix the housing 10 to a not-shown column head of an internal combustion engine.

Inside the housing 10, a columnar insulator 20 made of, e.g., alumina ceramic ($Al_2O_3$) is fixed. Further, a tip 21 of the insulator 20 is exposed from an edge of the housing 10.

The columnar central electrode 30 is fixed in an axial hole 22 of the insulator 20, thereby insulating the insulator 20 from the housing 10. The inner material of the central electrode 30 is a highly heat conductive material such as Cu, while the outer material thereof is a highly heat resistant and corrosion resistant material such as a Ni base alloy, Fe base alloy, or Co base alloy.

Further, the central electrode 30 comprises: a columnar body 31 received in the insulator 20; and a narrowed portion 32 narrower than the body 31. Further, a border portion 33 between the body and narrowed portion 33 is disposed in the insulator 20, while the narrowed portion 32 extends from the body 31 toward a projection 42 of an earth electrode 40. The outer circumference of the border portion 33 forms an edge portion which is a starting point of the leak current.

Further, the end surface 12 of the housing 10 is connected with the earth electrode 40 which comprises: a leg 41 welded to the housing 10; and a projection 42 welded to the leg 41.

The leg 41 is a square pillar made of a Ni base alloy, an end thereof is welded to the housing 10, is then bent like a nearly L shape and other end thereof is opposite against the narrowed portion 32. A surface 41*a* of the leg 41 opposite to the narrowed portion 32 is nearly parallel to the reference plane which is perpendicular to an axis 30*a* of the central electrode.

The projection 42 whose cross section is smaller than that of the leg 41 is joined to the surface 41*a* of the leg 41 and is projected from the leg 41 toward the narrowed portion 32. The projection 42 is opposite to the narrowed portion 32 at a discharge gap 50. The projection 42 is a column made of a noble metal such as a Pt alloy or Ir alloy. Further, the projection 42 may be joined to an end surface 41*b*.

Figure 2:
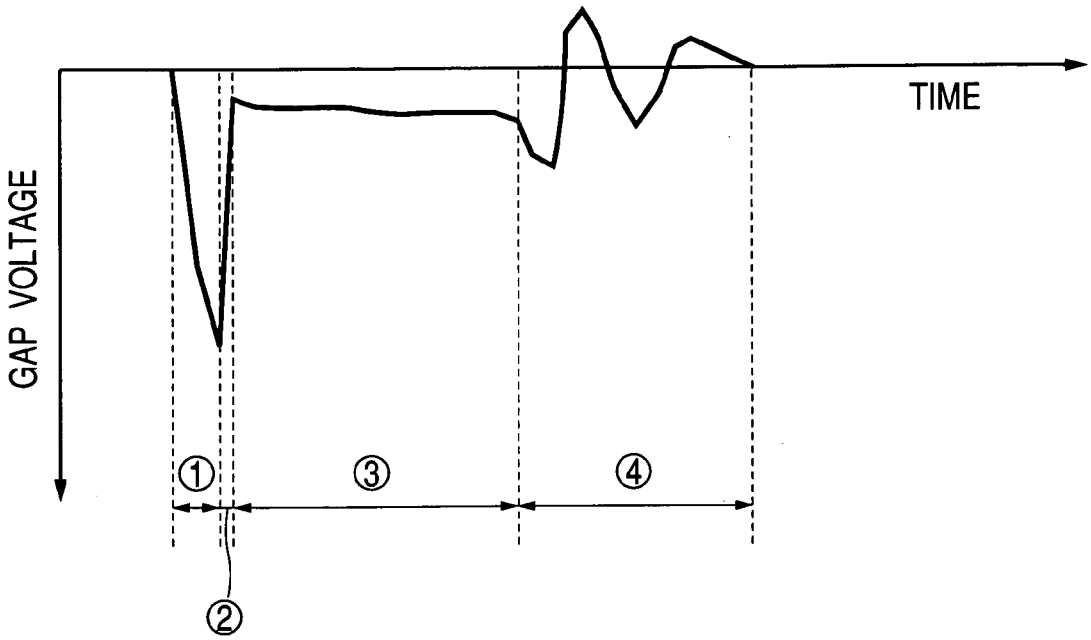
FIG. 2 is a wave form of a discharge voltage in a discharge gap as shown in FIG. 1.

FIG. 2 is a waveform of a discharge voltage at the discharge gap 50, wherein a voltage between 10 kV and 20 kV is usually applied between the electrode 30 and electrode 40 during a high voltage applying period ①. The capacitive discharge is caused during a capacitive discharge period ②. A voltage between 0.5 kV and 1 kV is usually applied in order to maintain the inductive discharge during an inductive discharge period ③. Further, a voltage between 0.5 kV and several kV is generated during a coil energy emission period ④ when an energy still left in an ignition coil even under the discharge is consumed in the ignition coil.

It is possible to lower the discharge voltage during capacitive discharge period ② by raising an electric field in the gap 50 due to the narrow projection 42, thereby suppressing the energy emitted from the coil during the capacitive discharge period ②. Therefore, the energy of the inductive discharge is relatively increased and the inductive discharge period ③ is extended. Thus, the carbon fouling is surely burnt down by the leak current during the inductive discharge period ③.

An optimum size of the projection 42 for burning down the carbon fouling was studied. Sample spark plugs with various lengths L and diameters D of the projection 42 were prepared, where the diameter "d" of the narrowed portion 32 of the central electrode 30 is 0.7 mm, the discharge gap 50 is 1.1 mm and the length A from the end surface 21 of the insulator 20 to the border portion 33 is 0.8 mm. The inductive discharge time period "t" of inductive discharge period ③ were measured under the various lengths L and diameters D. Here, the difference in the diameter of the central electrode 31 and the inner diameter of the insulator 20 is greater than or equal to 0.02 mm.

The inductive discharge time periods "t" were averaged over 1,000 discharges in the sample plugs with an ignition coil generally used for an automobile in a 0.4 Mpa chamber.

Figure 3:
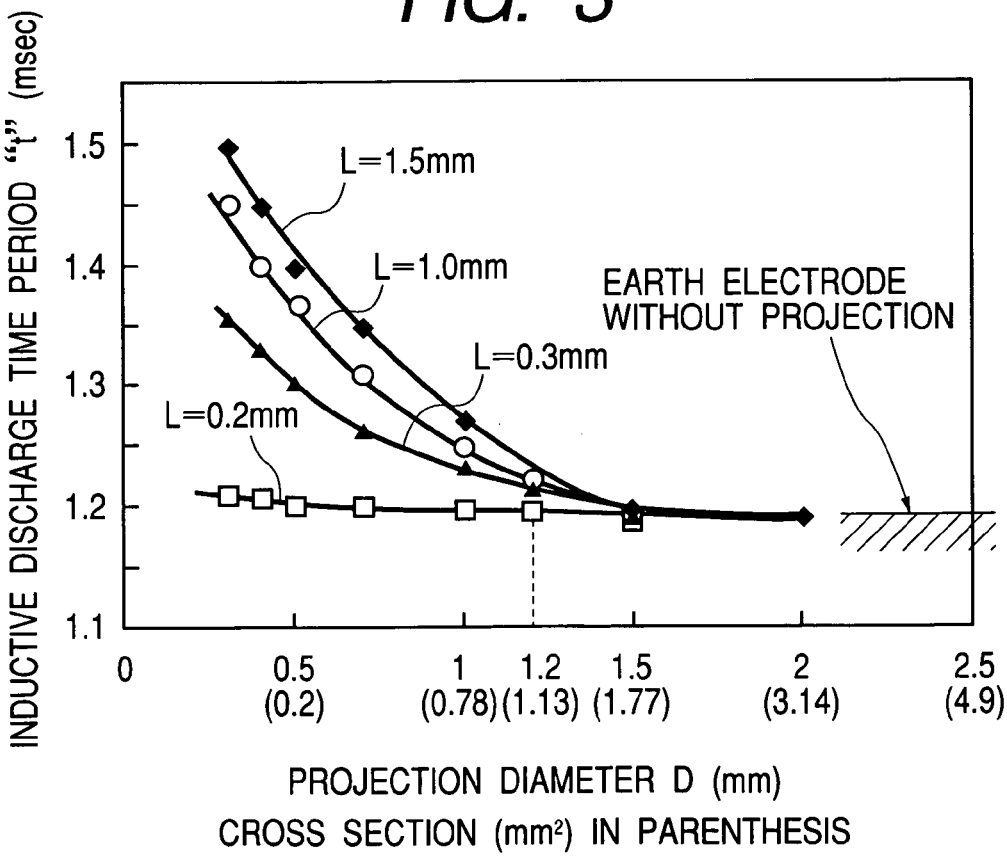
FIG. 3 is a graph showing measurement result of inductive discharge time period "t".

FIG. 3 is a graph of the inductive discharge time period "t" vs. the diameters D of the projection 42 of which cross section is also denoted in parenthesis. As shown in FIG. 3, "t" becomes longer, when L is longer than or equal to 0.3 mm and D is smaller than or equal to 1.2 mm (the cross section is smaller than or equal to 1.13 $mm^2$).

The sample plugs with the length L of the projection 42 longer than 1.5 mm and the diameter D of the projection 42 smaller than 0.3 mm (cross section smaller than 0.07 $mm^2$) are not suitable for practical use, because they are not heat resistant due to easy wearing out of the projection 42.

It was also confirmed that "t" becomes longer, when the diameter "d" of the narrowed portion 32 is between 0.4 mm and 1.2 mm, both inclusive, and the discharge gap 50 is between 0.5 mm and 1.2 mm, both inclusive.

Then, it was evaluated how well the carbon fouling is burned down due to extended time period "t" of the inductive discharge, by measuring the insulating resistance between the electrode 30 and electrode 40 after testing the sample plug mounted on an automobiles which actually executed test runs.

Sample spark plugs with various lengths L diameters D of the projection 42 were prepared, where the diameter "d" of the narrowed portion 32 of the central electrode 30 is 0.7 mm, the discharge gap 50 is 1.1 mm and the length A from the end surface 21 of the insulator 20 to the border portion 33 is 0.8 mm.

Those sample spark plugs are mounted on 4-cylinder 1600 cc engines on automobiles which actually executed test runs. It is determined whether the insulating resistances between electrode 30 and electrode 40 are maintained over 10 mega-ohms, after 10 cycles of a driving pattern corresponding to JIS-D-1606 including a engine start at minus 10° C., racing and rapid acceleration and deceleration at a low speed.

Figures 4, 5:
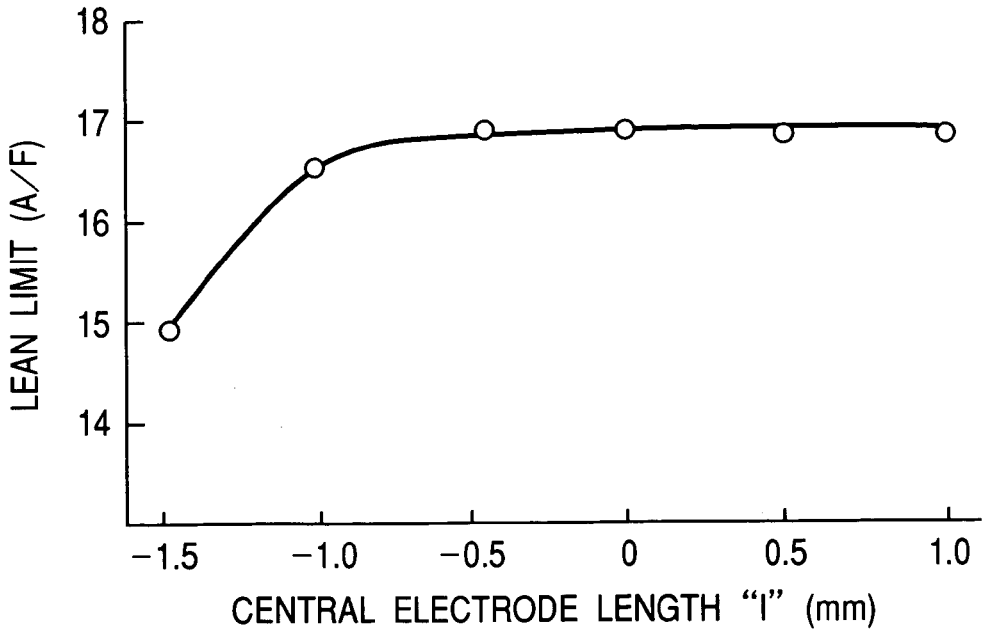
FIG. 4 is a table showing an evaluation result of an insulating resistance of each sample used on a vehicle which actually ran on road.
FIG. 5 is a graph showing a lean limit of each sample.

FIG. 4 shows a test result, where "○" denotes that the insulating resistances were greater than 10 mega-ohms, while "X" denotes that the insulating resistances were smaller than 10 mega-ohms.

As shown in FIG. 4, in the regions of D between 0.3 mm and 1.1 mm, both inclusive, (greater than or equal to 0.3 mm and smaller than or equal to 1.1 mm) with L greater than or equal to 0.3 mm and D between 1.1 mm and 1.2 mm, both inclusive, (greater than 1.1 mm and smaller than or equal to 1.2 mm) with L greater than or equal to 1.0 mm, the insulating resistances were maintained greater than 10 mega-ohms, thereby improving the carbon fouling burning-down effect due to the extended inductive discharge time period "t".

Other sample spark plugs were proved to improve the burning-down effect also in the region of D (greater than or equal to 0.3 mm and smaller than or equal to 1.1 mm) with L greater than or equal to 0.3 mm and D (greater than 1.1 mm and smaller than or equal to 1.2 mm with L greater than or equal to 1.0 mm, when the diameter "d" of the narrowed portion 32 is between 0.4 mm and 1.2 mm, both inclusive, the discharge gap 50 is between 0.5 mm and 1.2 mm, both inclusive, and furthermore, the length A from the surface 21 of the insulator 20 to the border portion 33 is between 0.1 and 1.2 mm, both inclusive.

It was confirmed on the basis of the above evaluation tests that the carbon burning-down capability is improved by setting the L and D of the projection 42 in a prescribed range, thereby extending the inductive discharge period "t" ③.

In the already cited Japanese Patents No. 2727558 and 2805781, the length "l" of the narrowed portion 32 projected from insulator end surface 21 was greater than or equal to zero and smaller than or equal to 1.0 mm in order to ensure the ignition capability and the discharge capability.

On the contrary, it was found out that "l" may be greater than or equal to minus 1 mm, due to the narrow projection 42 which is fixed to the earth electrode 40.

Figure 6:
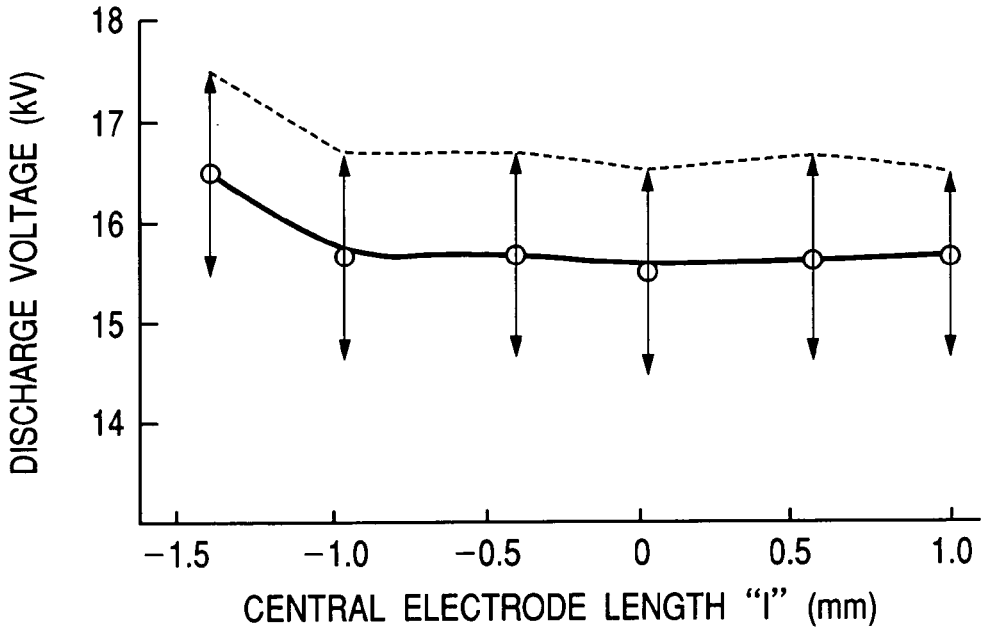
FIG. 6 is a graph showing a discharge voltage of each sample.

FIG. 5 shows a evaluation result of the ignition capability of sample spark plugs with various length "l" of the narrowed portion 32. Further, FIG. 6 shows a evaluation result of the discharge voltage. In FIGS. 5 and 6, the end surface of the narrowed portion 32 with the minus "l" is positioned inside the insulator 20.

The sample spark plug was of diameter "d" 0.7 mm, discharge gap 1.1 mm, length A 0.8 mm, length L 0.8 mm and diameter D 0.5 mm.

The ignition capability was evaluated by the lean limit in air-fuel (A/F) ratio at 800 rpm by the 4-cylinder 1600 cc engine. Further, the discharge voltage was evaluated by the average, maximum and minimum of 1,000 discharges in a 0.4 MPa chamber.

As shown in FIGS. 5 and 6, both the ignition capability and discharge capability were allowable for "l" greater or equal to minus 1 mm. This is because the flame cooling at an early stage burning at the earth electrode is reduced, due to the projection 42 with a small diameter. The similar allowable results were obtained for the projection of L between 0.3 mm and 1.5 mm, both inclusive, and D between 0.3 mm and 1.2 mm, both inclusive.

Further, in the already cited Japanese Patents No. 2727558 and 2805781, the length "l" of the narrowed portion 32 was smaller than or equal to 1.0 mm in order to ensure the carbon burning-down capability.

On the contrary, in the present invention, it was found out that the burning-out capability is also obtained for "l" greater than or equal to 1 mm, when the projection 42 is provided with the earth electrode 40.

Figure 7:
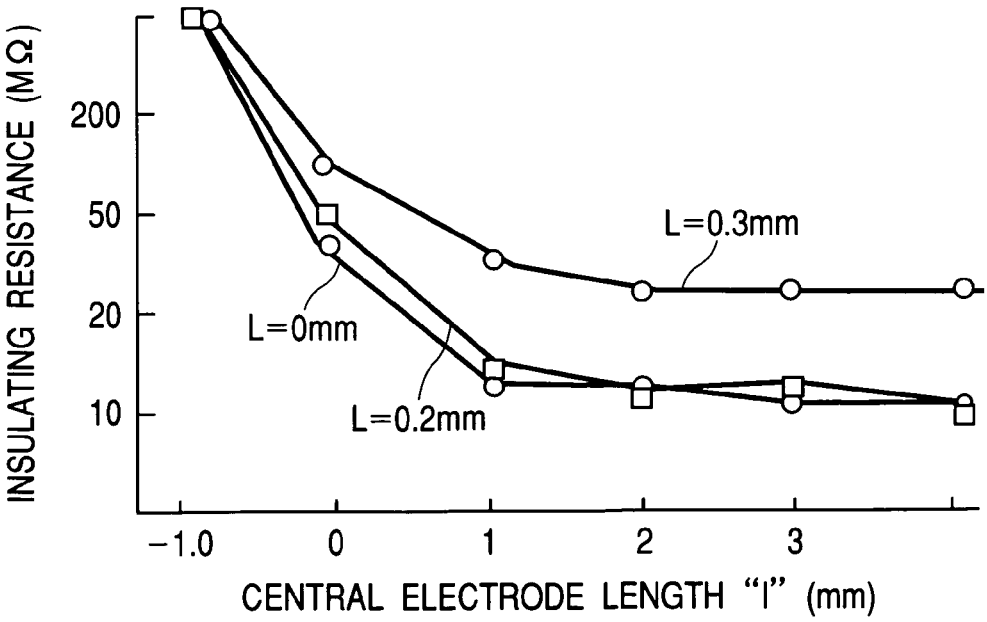
FIG. 7 is a graph showing an insulating resistance of each sample used on a vehicle which actually ran on road.

FIG. 7 shows the insulating resistance between central the electrode 30 and earth electrode 40 with various lengths L of the projection 42 and "l" of the narrowed portion 32.

The sample spark plugs were of diameter "d" 0.7 mm, discharge gap 1.1 mm, length A 0.8 mm, length L 0.8 mm and diameter D 0.5 mm. The insulating resistances between the electrode 30 and electrode 40 were measured after a 10 minute continuous rotation at 1200 rpm of 4-cylinder 1600 cc engine without load under dense air-fuel mixture atmosphere of A/F 10.0.

As shown in FIG. 7, the insulating resistances were maintained high enough to obtain a carbon burning-down capability allowable for practical use for the length L of the projection 42 greater than or equal to 0.3 mm, even when the length "l" of the narrowed portion 32 is greater than or equal to 1.0 mm.

This is because the inductive discharge period was extended by the projection 42, as already mentioned. It was observed that the leak current by the high voltage between 0.5 kV and 1 kV applied during the extended inductive discharge is also effective for the burning-out of the carbon fouling.

The inductive discharge following the capacitive discharge is utilized in order to burn down the carbon fouling in the already cited Japanese Patents No. 2727558 and 2805781. Further, the voltage applied during the inductive discharge is effectively utilized in the present invention, when length "l" of the narrowed portion 32 is long.

However, the length "l" is preferably smaller than 2 mm, taking into consideration the thermal resistance of the narrowed portion 32.

Embodiment 2

Figure 8:
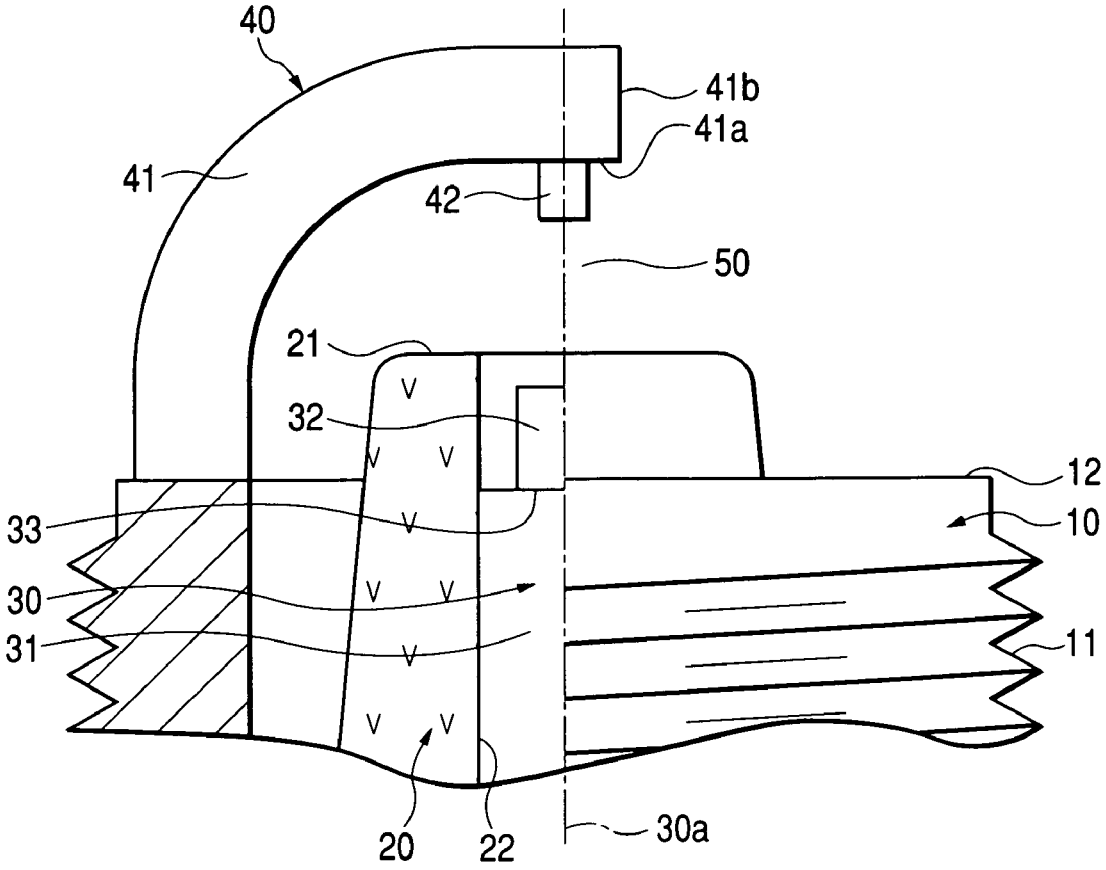
FIG. 8 is a fragmentary cross sectional view of a main portion of the spark plug of Embodiment 2.

FIG. 8 shows Embodiment 2, wherein the tip surface of the narrowed portion 32 is positioned in the insulator 20, thereby burning down the carbon fouling adhered on the insulator 20 near the tip of the narrowed portion 32 by the sparks generated between the tip of the narrowed portion 32 and the projection 42. Thus, the burning-down effect is further improved.

Embodiment 3

Figure 9:
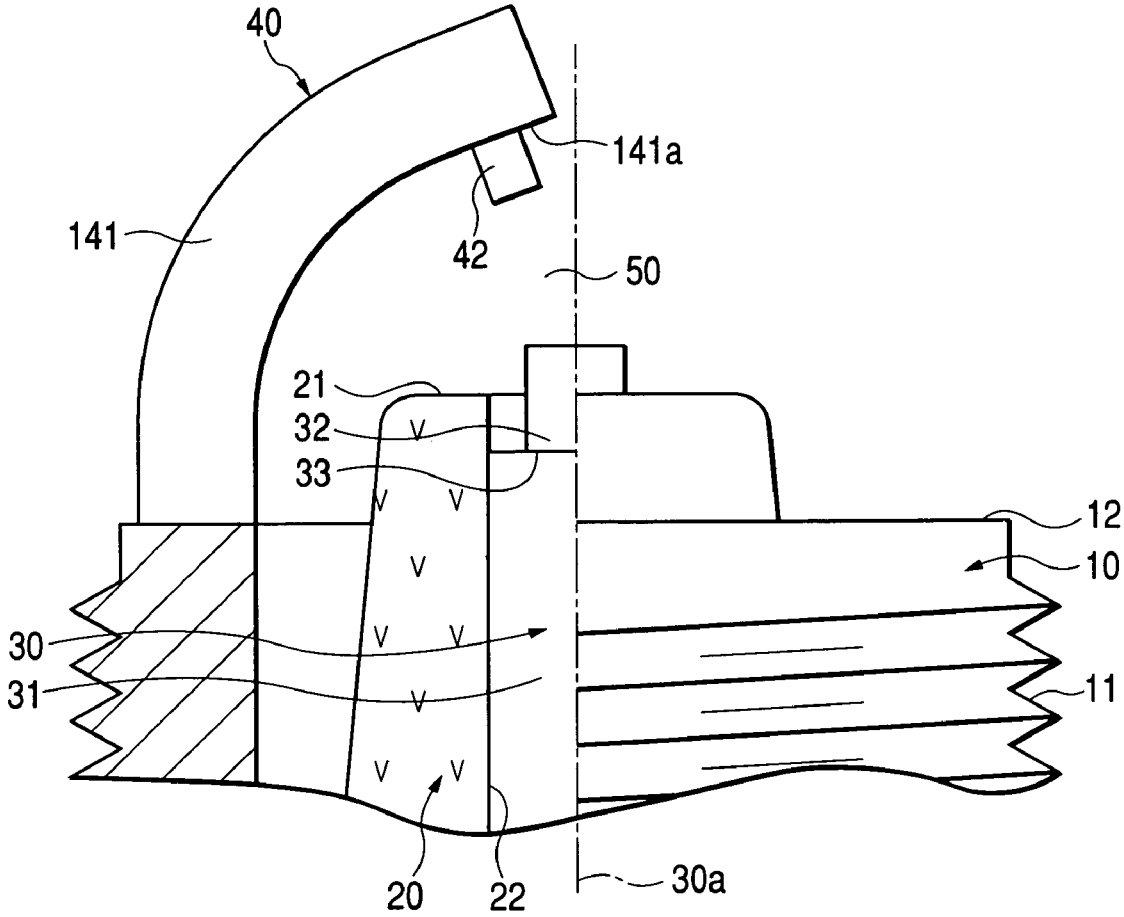
FIG. 9 is a fragmentary cross sectional view of a main portion of the spark plug of Embodiment 3.

FIG. 9 shows Embodiment 3, wherein a form of the leg 141 of the earth electrode 40 is different from that in Embodiment 1.

In Embodiments 1 and 2, the surface 141*a* opposite to the narrowed portion 32 was made nearly parallel to the reference surface perpendicular to the axis 30*a*. However, in Embodiment 3, the surface 141*a* is made tilted to the reference surface, thereby improving heat conductivity due to a shortened length of the leg 41.

Embodiment 4

Figure 10:
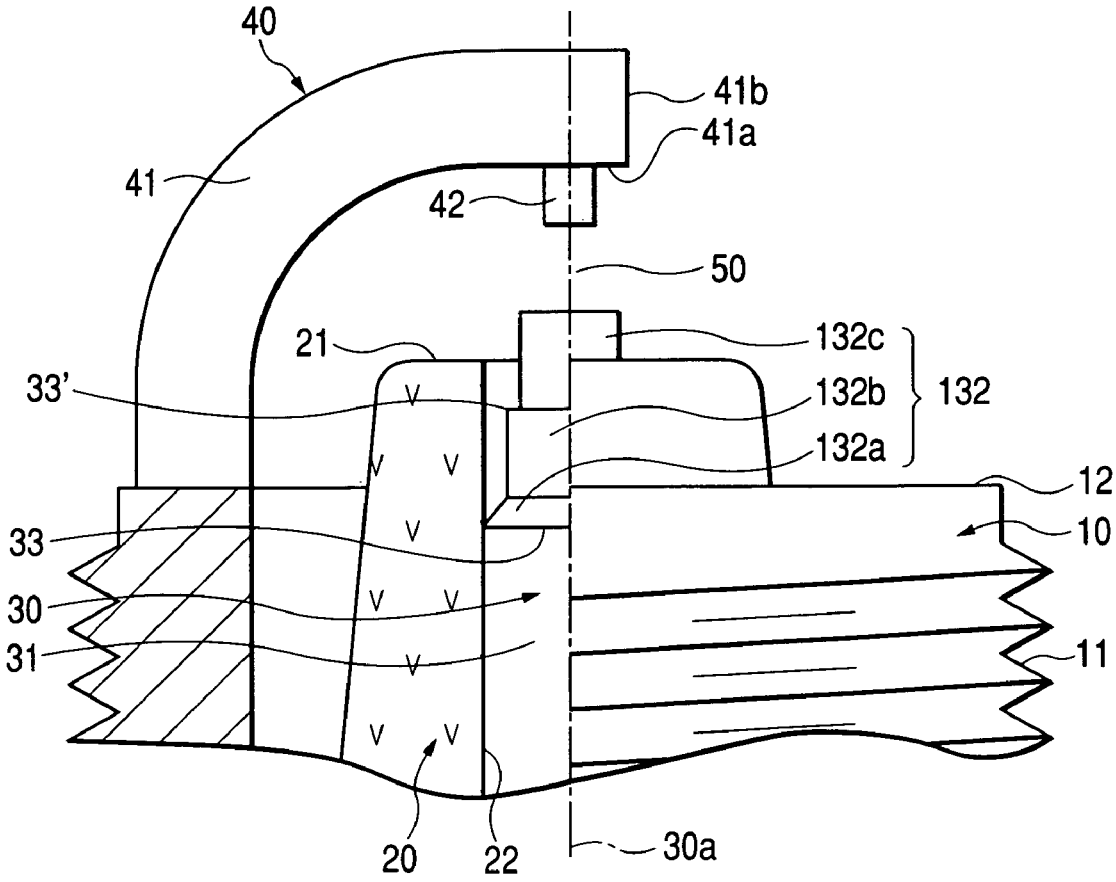
FIG. 10 is a fragmentary cross sectional view of a main portion of the spark plug of Embodiment 4.

FIG. 10 shows Embodiment 4, wherein the multistage narrowed portion 132 is different from the narrowed portion 32 in Embodiment 1.

The multistage narrowed portion 132 is made narrower by a plurality of stages from the body 31 toward the projection 42. Concretely, the multistage narrowed portion 132 comprises: a tapered member 132*a* of which cross section is continuously decreased; a first column 132*b* extending from the tapered member 132*a* (of which diameter is smaller than that of the body 31) extending from the tapered member 132*a*; and a second column 132*c* (of which diameter is smaller than that of the first column 132*b*) extending from the first column 132*b* toward the projection 42.

Further, a border portion 33' between the first column 132*b* and the second column 132*c* is positioned in the insulator 20. Therefore, the border portion 33' is also a starting point of the leak current.

According to the increased number of edge portions which become the starting points of the leak current, the ionization by the leak current before the capacitive discharge is not only further ensured, but also the carbon burning-down effect is further improved due to the increased inductive discharge energy and extended inductive discharge time period.

Embodiment 5

Figure 11:
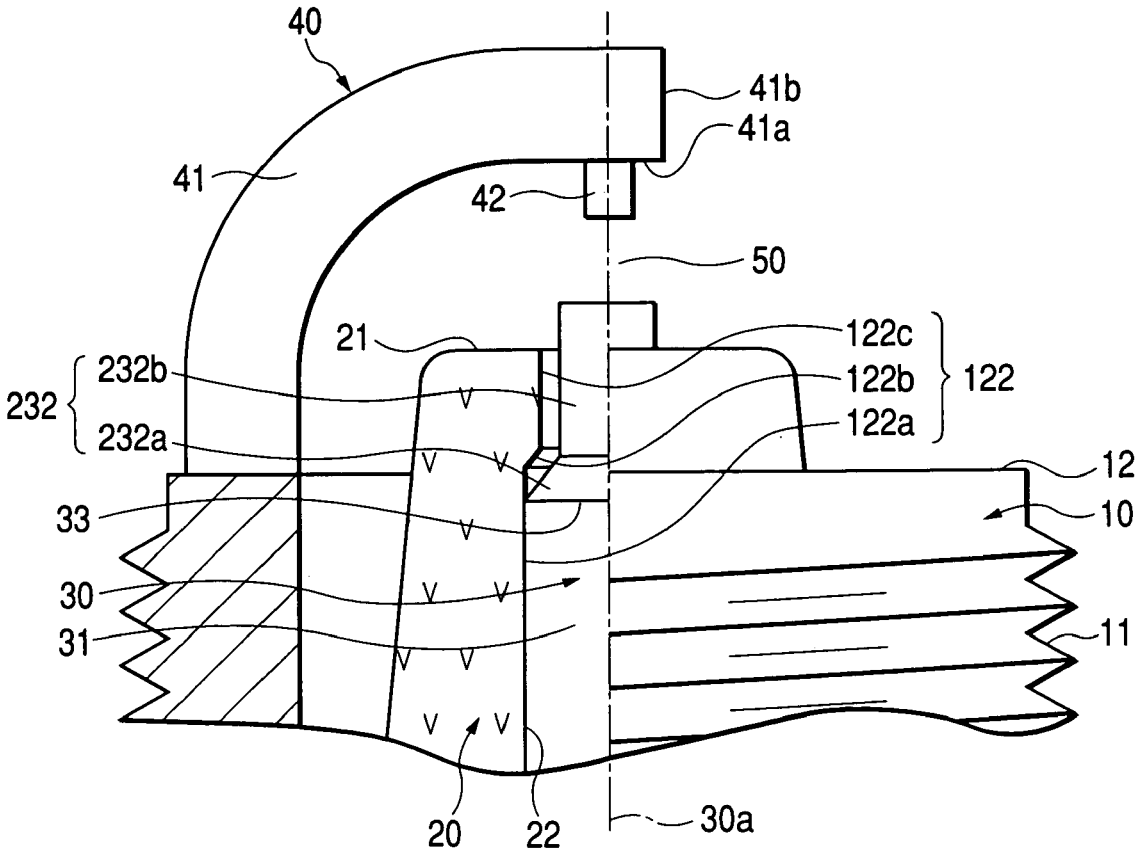
FIG. 11 is a fragmentary cross sectional view of a main portion of the spark plug of Embodiment 5.

FIG. 11 shows Embodiment 5. Similar reference numerals designate the corresponding portions in Embodiment 1. The explanations thereof are omitted.

In FIG. 11, the narrowed portion 232 comprises: a tapered member 232*a* of which cross section is continuously decreased from the body 31 toward the projection 42; and a column 232*b* (of which diameter is smaller than that of the body 31) extending from the tapered member 232*a* toward the projection 42.

Further, an axial hole 122 of the insulator 20 comprises: a first axial hole 122*a* for receiving the body 31; a tapered member 122*b* of which diameter is continuously decreased from the first axial hole toward end surface 21; and a second axial hole 122*c* (of which diameter is smaller than that of the first axial hole 122*a*) extending from the tapered member 122*b* toward the end surface 21 of the insulator 20.

Embodiment 6

Figure 12:
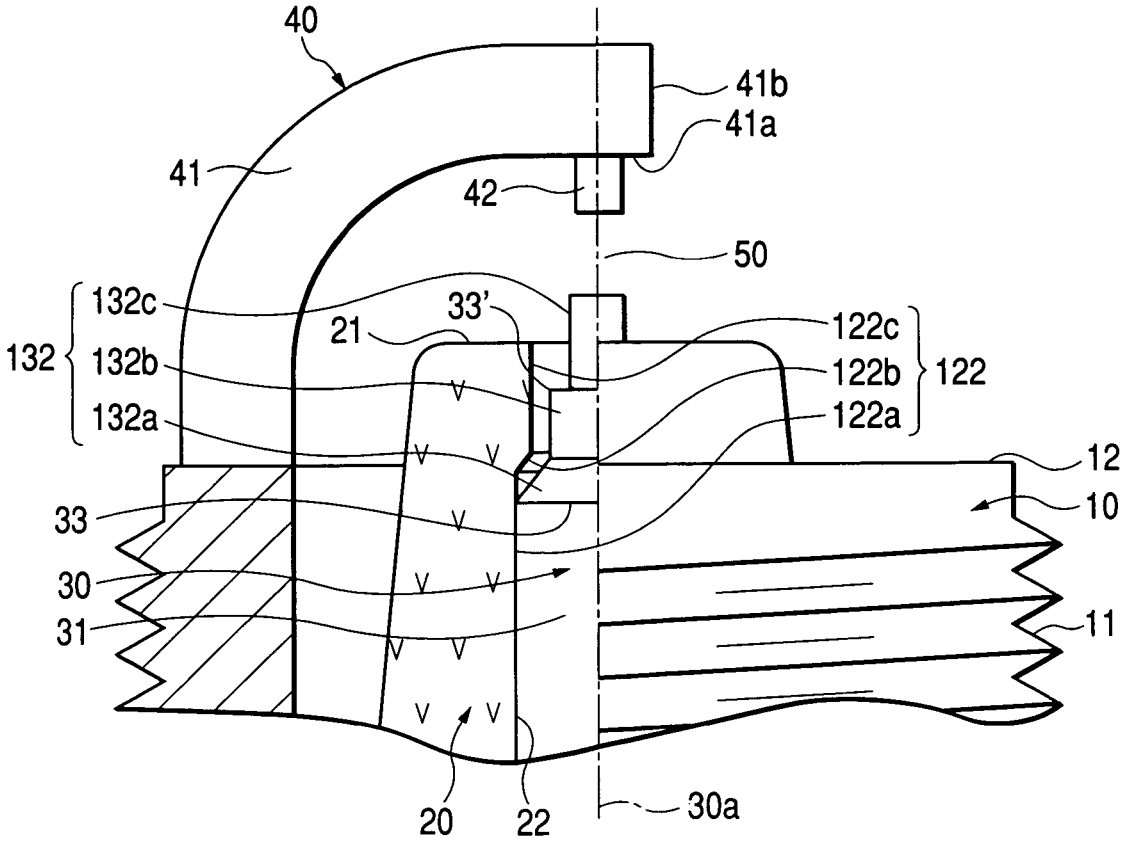
FIG. 12 is a fragmentary cross sectional view of a main portion of the spark plug of Embodiment 6.

FIG. 12 Shows Embodiment 6, wherein the narrowed portion 132 in Embodiment 4 as shown in FIG. 10 and the axial hole 122 in Embodiment 5 as shown in FIG. 11 are employed.

Embodiment 7

Figure 13:
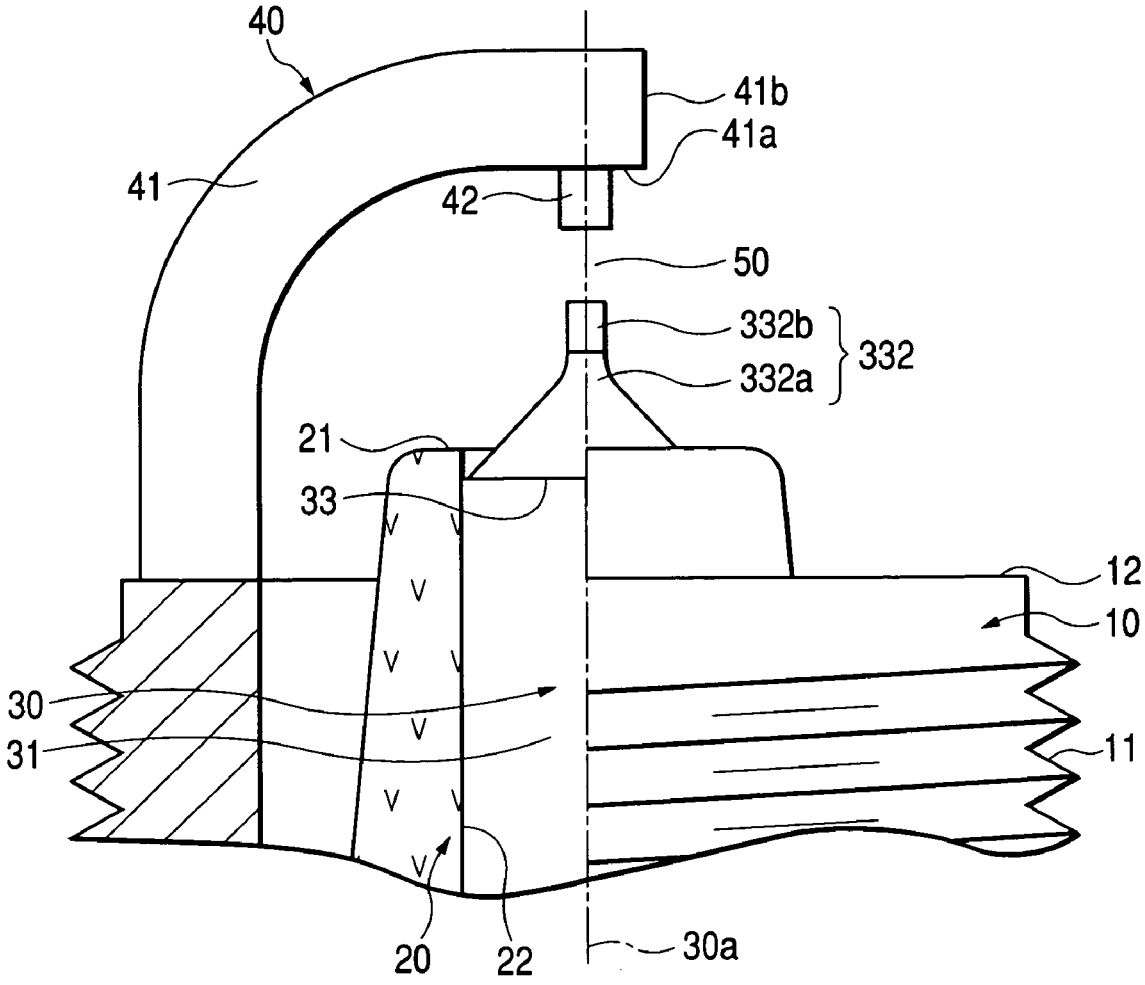
FIG. 13 is a fragmentary cross sectional view of a main portion of the spark plug of Embodiment 7.

FIG. 13 shows Embodiment 7, wherein the narrowed portion 332 is different from that in Embodiment 1.

In FIG. 13, the narrowed portion 332 comprises: a tapered member 332*a* of which cross section is continuously decreased from the body 31 toward the projection; and a column 332*b* (of which diameter is smaller than that of the body 31) extending from the tapered member 332*a* toward the projection 42.

Embodiment 8

Figure 14:
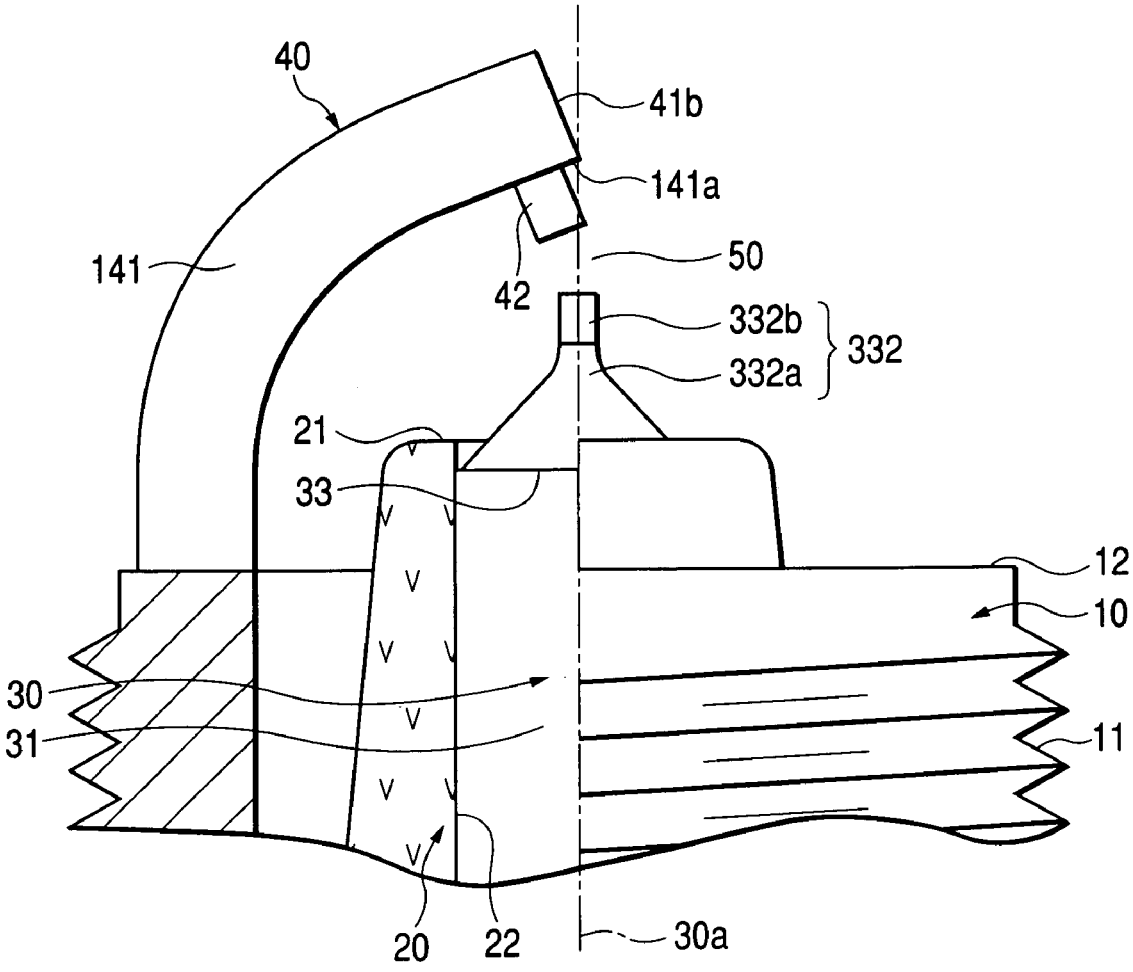
FIG. 14 is a fragmentary cross sectional view of a main portion of the spark plug of Embodiment 8.

FIG. 14 shows Embodiment 8, wherein the narrowed portion 332 in Embodiment 7 as shown FIG. 13 and the leg 141 as shown in FIG. 9 are employed.

Embodiment 9

Figure 15:
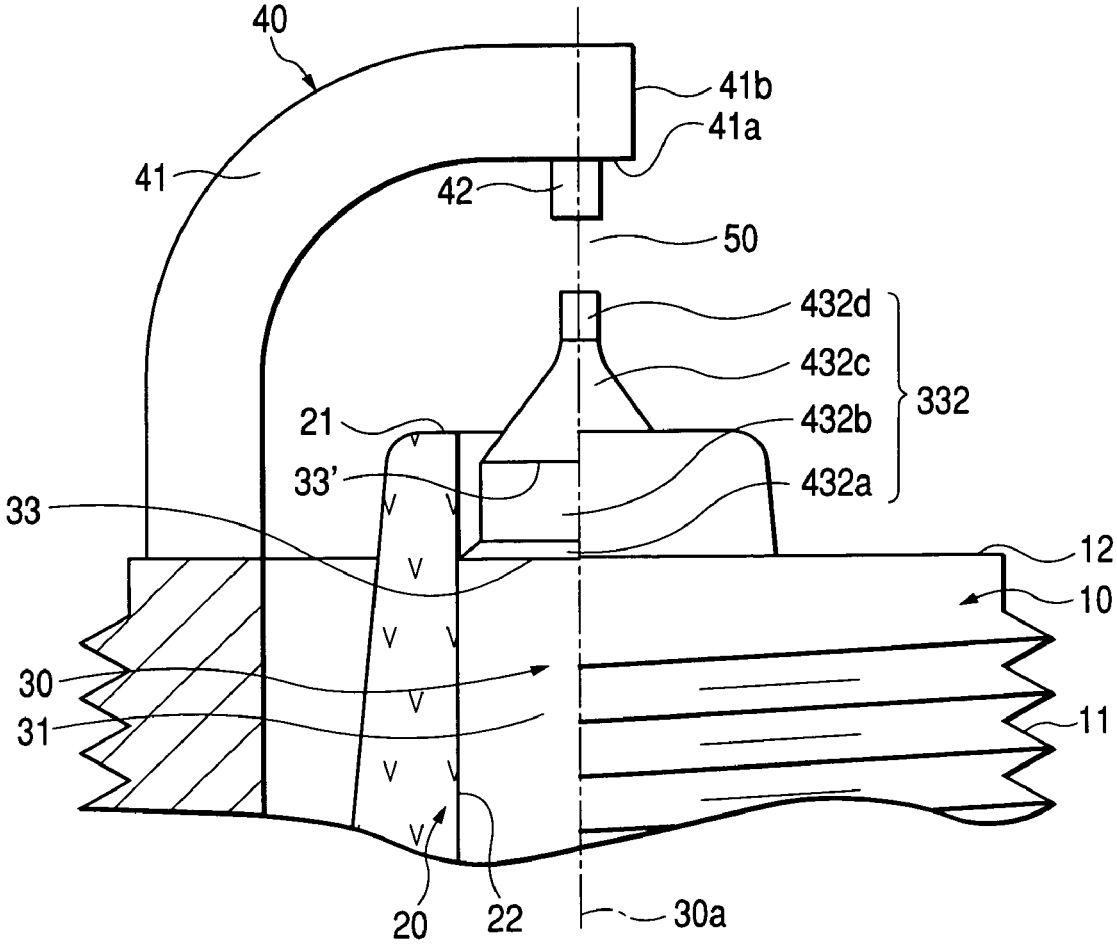
FIG. 15 is a fragmentary cross sectional view of a main portion of the spark plug of Embodiment 9.

FIG. 15 shows Embodiment 9, wherein a form of the narrowed portion 432 is different from that in Embodiment 1.

The narrowed portion 432 is narrowed a plurality of times from the body 31 toward the projection 42. Concretely, the narrowed portion 432 comprises: a first tapered member 432*a* of which cross section is continuously decreased from the body toward the projection; a first column 432*b* (of which diameter is smaller than that of the body 31) extending from the first tapered member 432*a* toward the projection 42; a second tapered member 432*c* of which cross section is continuously decreased from the first column 432*b* toward the projection 42; and a second column 432*d* (of which diameter is smaller than that of the first column 432*b*) extending from the second tapered member 432*c* toward the projection 42.

Further, a border portion 33' between the first column 432*b* and the second tapered member 432*c* is positioned in the insulator 20. Therefore, the border portion 33' is also a starting point of the leak current.

According to the increased number of edge portions which become the starting points of the leak current, the ionization by the leak current before the capacitive discharge is not only further ensured, but also the carbon burning-down effect is further improved due to the increased inductive discharge energy and extended inductive discharge time period.

Other Embodiments

Although the projection 42 was a column in the above-mentioned Embodiments, the cross section of the projection 42 may be a square, rhomb, ellipse, or rectangle.

Although the projection 42 of the earth electrode 40 was made of noble metal, the narrowed portion 32, 132*c*, 232*b*, 332*b* and 432*d* may be made of noble metal.

Further, the narrowed portion 32, 132*c*, 232*b*, 332*b* and 432*d* and the projection 42 of the earth electrode 40 may be made of one of Pt—Ir, Pt—Rh, Pt—Ni, Ir—Rh, or Ir—Y.

Furthermore, the narrowed portion 32, 132*c*, 232*b*, 332*b* and 432*d* and the projection 42 of the earth electrode 40 may be made of a Pt alloy in which at least one of Ir, Ni, Rh, W, Pd, Ru, Os is added. More concretely, the Pt alloy in which at least one of less than or equal to 50 wt. % Ir, less than or equal to 40 wt. % Ni, less than or equal to 50 wt. % Rh, less than or equal to 30 wt. % W, less than or equal to 40 wt. % Pd, less than or equal to 30 wt. % Ru, or less than or equal to 20 wt. % Os may be employed.

Furthermore, the narrowed portion 32, 132*c*, 232*b*, 332*b* and 432*d* and the projection 42 of the earth electrode 40 may be made of an Ir alloy in which at least one of Rh, Pt, Ni, W, Pd, Ru, Os is added. More concretely, the Ir alloy in which at least one of less than or equal to 50 wt. % Rh, less than or equal to 50 wt. % Pt, less than or equal to 40 wt. % Ni, less than or equal to 30 wt. % W. less than or equal to 40 wt. % Pd, less than or equal to 30 wt. % Ru, or less than or equal to 20 wt. % Os may be employed.

What is claimed is:

1. A spark plug for an internal combustion engine comprising:

a columnar central electrode;

an insulator for holding said central electrode;

a housing for holding said insulator;

an earth electrode wherein one end thereof is connected with said housing and the other end thereof is opposite to said central electrode, wherein:

said earth electrode has a leg connected with said housing and a projection having a cross section smaller than that of said leg, said projection projecting from said leg toward said central electrode;

said central electrode has a body held in said insulator and a narrowed portion smaller than said body, said narrowed portion projecting from said body toward said projection;

a first border portion between said body and narrowed portion is positioned in said insulator;

a length of said projection projecting from said leg is between 0.3 and 1.5 mm, both inclusive;

a cross section of said projection is between 0.07 and 1.13 $mm^2$, both inclusive;

said narrowed portion includes a tapered member, the cross section of which is continuously decreased from said body toward said projection;

a length of said narrowed portion from a top thereof to an end of said insulator is greater than 1 mm.

2. The spark plug according to claim 1, which further comprises a second border portion formed in an edge shape between said body and narrowed portion is positioned in an axial hole of said insulator.

3. The spark plug according to claim 2, wherein said second border portion is positioned between 0.1 mm and 1.2 mm, both inclusive, from an end surface of said insulator.

4. The spark plug according to claim 2, wherein a leak current flows from the second border portion to the insulator to ionize carbon disposed on the insulator.

5. The spark plug according to claim 1, wherein a surface of said earth electrode opposite to said central electrode is tilted from a surface perpendicular to an axis of said central electrode.

6. The spark plug according to claim 1, wherein said projection is made of noble metal material.

7. The spark plug according to claim 6, wherein said noble metal material is a Pt alloy or Ir alloy.

8. The spark plug according to claim 1, wherein said first border portion is positioned between 0.1 mm and 1.2 mm, both inclusive, from an end surface of said insulator.

9. The spark plug according to claim 1, wherein said narrowed portion is narrowed a plurality of times from said body toward said projection.

10. The spark plug according to claim 1, wherein said narrowed portion is made of noble metal material.

11. The spark plug according to claim 10, wherein said noble metal material is a Pt alloy or Ir alloy.

12. The spark plug according to claim 1, wherein the length of said narrowed portion is smaller than 2 mm.

13. The spark plug according to claim 1, further comprising a second narrowed portion positioned in an axial hole of said insulator, said second narrowed portion being smaller than said body and larger than the first narrowed portion, wherein the first border portion is disposed between said body and said second narrowed portion and wherein a second border portion is disposed between said second narrowed portion and the first narrowed portion and is positioned in the axial hole of said insulator.

14. The spark plug according to claim 1, wherein the spark plug has a single earth electrode so as not to generate sparks between the central electrode and any element other than the single earth electrode.

15. The spark plug according to claim 1, wherein the first border portion has a leak current starting portion disposed on an outer circumference thereof to generate a leak current leaking from the leak current starting portion to the insulator.

16. The spark plug according to claim 15, wherein the leak current ionizes carbon disposed on the insulator.

17. The spark plug according to claim 1, wherein the first border portion has a leak current starting portion to generate a leak current leaking from the leak current starting portion to the insulator and to burn down carbon disposed on the insulator during an inductive discharge period of sparks between the central electrode and the earth electrode.

18. A spark plug for an internal combustion engine, the spark plug comprising:

a central electrode;

an insulator having an axial hole to hold the central electrode disposed in the axial hole;

a housing for holding the insulator;

an earth electrode having one end thereof connected with the housing and the other end thereof opposed to the central electrode through a discharge gap, wherein:

the earth electrode includes a leg connected with the housing and a projection having a cross section smaller than that of the leg, the projection projects from the leg toward the central electrode to face the central electrode through the discharge gap, the central electrode has a body disposed in the axial hole of the insulator and a narrowed portion projecting from the body toward the projection of the earth electrode, the narrowed portion has a cross section smaller than that of the body, a border surface defined between the body and the narrowed portion is positioned in the axial hole of the insulator, an edge portion is defined on an outer circumferential edge of the border surface to generate a leak current leaking from the edge portion to the insulator, a length of the projection projecting from said leg is between 0.3 and 1.5 mm, both inclusive, a cross section of the projection is between 0.07 and 1.13 $mm^2$, both inclusive, a length of the narrowed portion from a top thereof to an end of said insulator is greater than 1 mm, and the narrowed portion includes a tapered member, the cross section of which is continuously decreased from the body toward the projection.

* * * * *